US006010415A

United States Patent [19]

Miggins

[11] Patent Number: 6,010,415

[45] **Date of Patent: *Jan. 4, 2000**

[54] WEIGHTED PRACTICE BAT

[76] Inventor: Lawrence E. Miggins, 2405 Kingston Dr., Houston, Tex. 77019

[ * ] Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 75 days.

[21] Appl. No.: 08/864,442

[22] Filed: May 27, 1997

Related U.S. Application Data

[63] Continuation of application No. 08/656,087, May 31, 1996, abandoned.

[51] Int. Cl.[7] ..... A63B 59/00; A63B 59/06

[52] U.S. Cl. ..... 473/437; 473/457; 473/564

[58] Field of Search ..... 473/564, 261, 473/429, 234, 242, 257, 463, 457, 437, 566, 520

[56] References Cited

U.S. PATENT DOCUMENTS

| | | | |
|---|---|---|---|
| 3,136,546 | 6/1964 | Connolly . | |
| 3,351,346 | 11/1967 | Strahan . | |
| 3,521,883 | 7/1970 | Hamilton | 473/564 |
| 3,955,816 | 5/1976 | Bratt | 473/457 |
| 4,063,730 | 12/1977 | Bates . | |
| 4,260,150 | 4/1981 | Tabet . | |
| 4,331,330 | 5/1982 | Worst | 473/564 |
| 4,364,560 | 12/1982 | Gemmel . | |
| 4,674,746 | 6/1987 | Benoit . | |
| 4,679,791 | 7/1987 | Hull | 473/201 |
| 4,819,935 | 4/1989 | Dirksing | 473/564 |

OTHER PUBLICATIONS

Sporting Goods Dealers May 1975, p. 146, 273/29A.

*Primary Examiner*—Sebastiano Passaniti

*Attorney, Agent, or Firm*—Akin, Gump, Strauss, Hauer & Feld, L.L.P.

[57] ABSTRACT

A weighted practice bat comprising a bat having a barrel and a handle and the bat having a determinable center of percussion. A weighted ring is attached to the barrel at the location of the center of percussion. The ring includes a hole for receiving a fastener which engages the barrel and secures the ring to the barrel.

7 Claims, 1 Drawing Sheet

WEIGHTED PRACTICE BAT

This is a continuation of application Ser. No. 08/656,087 filed on May 31, 1996 now abandoned.

BACKGROUND OF THE INVENTION

1. Field of the Invention

The invention relates to baseball bats, and more particularly to weighted practice bats.

2. Description of the Prior Art

In the old days, big league baseball teams would drill a hole in the hitting end of an old baseball bat, place about 16 ounces of lead in it and have this weighted bat available at the "on deck" circle so that the next hitter could swing it before he entered the batter's box. The obvious purpose of swinging this weighted or "loaded" bat was to make the hitter's own bat feel much lighter in contrast so that the hitter could have a faster swing or a "quick bat" as the term is used.

Some players preferred to carry two or three bats to the "on deck" circle and would practice swinging them together before entering the batter's box. Most players used the "loaded" bat, however, in the distant past.

About twenty or so years ago the "donut" was developed. This is a metal ring approximately one pound in weight covered in thick plastic (usually red in color). The donut, when slipped over the bat handle, lodges up near the label or "trademark" on the bat identifying the company which made the bat. This is usually a few inches beyond the mid-section of the bat. The donut was an improvement over the lead weighted bat because the hitter could place the donut on his own bat, weight down the bat and practice swinging with a bat with which the hitter was familiar. Before hitting the hitter simply removed the donut by hitting the handle of the bat against the ground and it would fall off.

In recent years another device was invented termed the "Pow'r- Wrap" sleeve which was made entirely of heavy plastic (from ½ to ¾ inches thick) and about seven inches long. The Pow'r-Wrap sleeve is manufactured by Grand Enterprises West, Inc., Minneapolis, Minn. This device, weighing about 16 ounces, was shaped like a cone and was approximately 2¾ inches wide on the receiving end where it was slipped over the knob of the bat and about 2⅝ inches on the other end. The Pow'r-Wrap sleeve lodged further up on the hitting surface of the bat than the donut and actually covered the "sweet spot" or the center of percussion on some bats tested. This device distributed the weight over a greater portion of the bat then the donut did but neither the donut or the Pow'r-Wrap sleeve told you where the sweet spot was located on the bat to which they were applied.

If a batter is going to develop maximum power with his swing he has to hit the ball solidly at or very close to the sweet spot or the center of percussion. This is no easy task but the batter certainly is not going to develop this skill unless he knows where the sweet spot is located. When the batter knows where it is, he practices playing "pepper" and batting practice until he is aware unconsciously where it is located and proceeds with the business of hitting the ball at the sweet spot or near it in order to maximize power. When the batter contacts the ball solidly on the sweet spot there is no reaction or vibration in the hands and the ball is propelled like a rocket providing, of course, the batter has great bat speed and hits the ball on its sweet spot at the center of the ball.

U.S. Pat. No. 5,269,177 to Miggins et al. discloses an apparatus and method for determining the subjective sweet spot or center of percussion for a baseball bat or softball bat regardless of what the bat is made of, be it wood, metal, graphite or other material.

When a baseball player hits a prodigious home run, he is sometimes amazed at the apparent ease with which he accomplished this feat. He may even feel that he could have swung harder than he did because it seemed so effortless to hit the ball that far. In actuality, the baseball player has taken his normal swing but he contacted the ball at the "sweet spot" or center of percussion of the baseball bat. The center of be secured to the barrel 12 with screws, pins or other fastening means 22 known to those skilled in the art. The weighted ring 18 is preferably coated with a rubber or plastic layer to provide a resilient outer layer on the weighted ring 18. Preferably, the weighted ring 18 weighs up to approximately 16 ounces to provide a weighted practice bat 100. Preferably, the weighted practice bat 100 is similar in all respects to the batter's normal bat 10 which he is familiar with except for the addition of the weighted ring 18. The weighted practice bat 100 locates the weighted ring 18 at the exact sweet spot 20 of the bat 100. Thus, as the batter loosens up in the on deck circle with the weighted practice bat 100, the batter is made aware of the exact sweet spot 20 at which he wants to contact the ball.

The advantages of the weighted practice bat 100 are plentiful. The batter has a weighted practice bat to loosen up with which has the same size handle and length as his bat which he will use when facing the opposing pitcher. The weighted ring 18 is permanently secured at the exact sweet spot 20 of the weighted practice bat 100. The weighted ring 18 will not unexpectedly fly off of the bat 100. The weighted ring 18 always remains positioned over the sweet spot 20 which informs any player using the "regular" bat 10 of similar size and shape of the location of the sweet spot 20. The weight added to the bat is concentrated at the location of the sweet spot 20. The enlarged outer diameter of the weighted ring focuses the batter's attention directly to the location of the sweet spot 20 which is exactly where the batter's attention should be in order for the batter to learn where to instinctively make contact with the ball on the bat.

Under no circumstances should it be possible that the weighted material free itself from the bat 100 and become a flying projectile.

Having described the invention above, various modifications of the techniques, procedures, material and equipment will be apparent to those in the art. It is intended that all such variations within the scope and spirit of the appended claims be embraced thereby.

BRIEF DESCRIPTION OF THE DRAWINGS

In order to more fully understand the drawings referred to in the detailed description of the present invention, a brief description of each drawing is presented, in which.

DETAILED DESCRIPTION OF THE INVENTION

Figure 1:
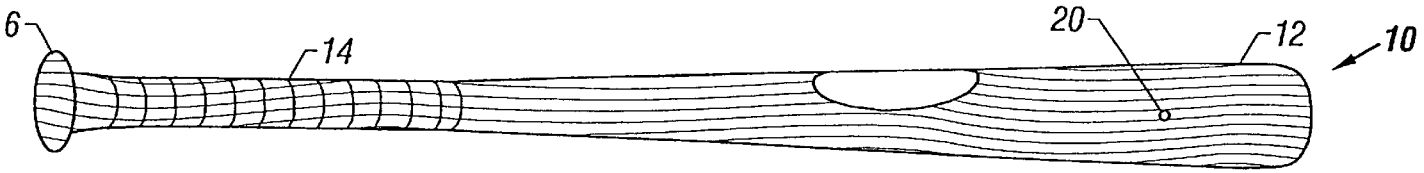
FIG. 1 is a side view of a typical baseball or softball bat.

A typical baseball or softball bat is shown in FIG. 1. The bat, generally designated as reference numeral 10, includes a barrel 12, a handle 14 and a knob 16. It is to be understood that the length, the weight and the distribution of the mass of the bat 10 will vary from bat to bat as a result of the many variables involved. The "sweet spot" or center of percussion will vary depending on the size, shape and mass distribution of the bat 10.

Applicant's U.S. Pat. No. 5,269,177 discloses an apparatus and method for determining the subjective sweet spot or center of percussion 20 such as shown in FIG. 1. As discussed above, a hit ball will travel farther when striking the sweet spot 20 of the bat 10. Thus, it is very important to the batter to know where the subjective sweet spot 20 is on his bat.

Figure 2:
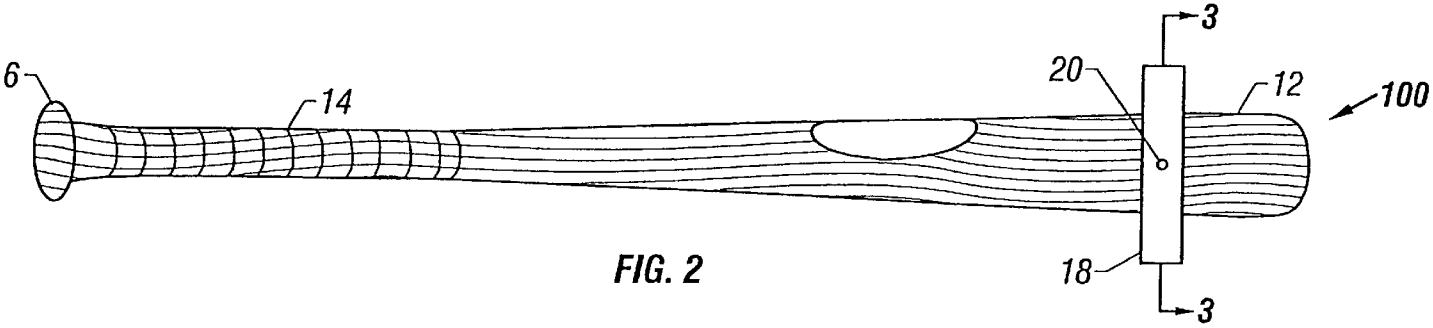
FIG. 2 is a side view of a weighted practice bat according to the present invention.
Figure 3:
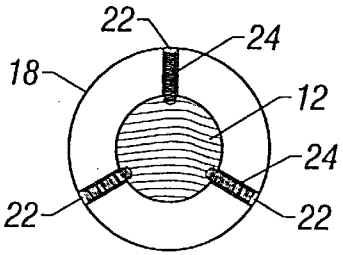
FIG. 3 is a view taken along lines 3—3 of FIG. 2.

Referring to FIG. 2, a weighted practice bat 100 is shown having a barrel 12, a handle 14, and a knob 16. The weighted practice bat 100 also includes a weighted ring 18 positioned at the subjective sweet spot 20 of the weighted practice bat 100. Preferably, the weighted ring 18 has an internal diameter approximating the diameter of the barrel 12 at the location of the sweet spot 20. Preferably, the ring 18 has a width of approximately ½" to 1½ inches. The ring 18 includes one or more radial holes 24 for receiving screws 22 or threaded fasteners (for wood or metal bats) to secure the ring 18 to the barrel 12. The weighted ring 18 is permanently secured to the barrel 12 of the weighted practice bat 100. Referring to FIG. 3, the ring 18 may percussion of baseball bat is, by definition, the point at which the bat can hit the baseball at that point where all the power of the bat is concentrated thus experiences little or no reaction force in the hands of the batter. Stated another way, the sweet spot or center of percussion is the point at which a baseball bat can collide with a baseball while causing the minimum amount of reactionary vibration at the hands of the batter.

It is desirable to have a weighted practice bat for the on deck circle which clearly identifies the sweet spot. It is also desirable to concentrate the "weight" of the weighted practice bat at the sweet spot. It is further desirable that the weighted practice bat be available in the substantially same size as the hitter's regular bat; in fact, it could be one of his regular bats fitted with a permanent weight at the sweet spot. He would then enter the batter's box with his own bat marked at the sweet spot so that he can concentrate on making contact as close to this spot as possible. Repetition and practice should make this task easier.

SUMMARY OF THE INVENTION

The weighted practice bat of the present invention places a weight on the exact sweet spot on the bat and the weight is secured permanently at this location. The weighted practice bat is an "on deck" bat which tells the batter where he wants to contact the ball. Preferably, a player can attach the weight (up to 16 ounces) to one of his own bats and use this familiar bat while he's waiting "on deck."

Weighted practice bats could be fashioned for those who use 34" bats and 35" bats down to smaller bats used in junior leagues.

The amount of weight could vary from 16 ounces down depending on the strength of the batter. It also could be painted in plastic and could accommodate a variety of colors to suit team colors.

What is claimed is:

1. A weighted practice bat comprising:

a bat having a barrel and a handle, said barrel having a length and a circular cross-section along said length, said bat having a determinable center of percussion;

a weighted ring securely positioned on said barrel at the location of the center of percussion, said weighted ring having an inner diameter approximating the diameter of said barrel at the location of the center of percussion; and means for permanently securing said weighted ring to said barrel.

2. The bat of claim 1, wherein said weighted ring weighs approximately 16 ounces.

3. The bat of claim 1, wherein said securing means comprises:

a hole in said weighted ring; and a fastener received in said hole and engaging said barrel.

4. The bat of claim 2, wherein said securing means comprises:

a hole in said weighted ring; and a fastener received in said hole and engaging said barrel.

5. A weighted practice bat comprising:

a bat having a barrel and a handle, said barrel having a length and a circular cross-section along said length, said bat having a determinable center of percussion; and a weighted ring permanently secured on said barrel at the location of the center of percussion.

6. In a practice bat adapted to improve the batting ability of a batter, the practice bat having a barrel and a determinable center of percussion, said barrel having a length and a circular cross-section along said length, the improvement comprising:

a weighted ring securely positioned on the barrel at the location of the center of percussion, said weighted ring having an inner diameter approximating the diameter of the barrel at the location of the center of percussion; and means for permanently securing said weighted ring to said barrel.

7. The practice bat of claim 6, wherein said securing means comprises:

a hole in said weighted ring; and a fastener received in said hole and engaging the barrel.

* * * * *

UNITED STATES PATENT AND TRADEMARK OFFICE

CERTIFICATE OF CORRECTION

PATENT NO. : 6,010,415
DATED : January 4, 2000
INVENTOR(S) : Lawrence E. Miggins It is certified that error appears in the above-identified patent and that said Letters Patent is hereby corrected as shown below:

Column 2,
Line 11, cancel beginning with "be secured" to and including "embraced thereby."
Line 48, insert the following:
-- percussion of baseball bat is, by definition, the point at which the bat can hit the baseball at that point where all the power of the bat is concentrated thus experiences little or no reaction force in the hands of the batter. Stated another way, the sweet spot or center of percussion is the point at which a baseball bat can collide with a baseball while causing the minimum amount of reactionary vibration at the hands of the batter.

It is desirable to have a weighted practice bat for the on deck circle which clearly identifies the sweet spot. It is also desirable to concentrate the "weight" of the weighted practice bat at the sweet spot. It is further desirable that the weighted practice bat be available in the substantially same size as the hitter's regular bat, in fact, it could be one of his regular bats fitted with a permanent weight at the sweet spot. He would then enter the batter's box with his own bat marked at the sweet spot so that he can concentrate on making contact as close to this spot as possible. Repetition and practice should make this task easier.

SUMMARY OF THE INVENTION

The weighted practice bat of the present invention places a weight on the exact sweet spot on the bat and the weight is secured permanently at this location. The weighted practice bat is an "on deck" bat which tells the batter where he wants to contact the ball. Preferably, a player can attach the weight (up to 16 ounces) to one of his own bats and use this familiar bat while he's waiting "on deck."

Weighted practice bats could be fashioned for those who use 34" bats and 35" bats down to smaller bats used in junior leagues.

The amount of weight could vary from 16 ounces down depending on the strength of the batter. It also could be painted in plastic and could accommodate a variety of colors to suit team colors. --

UNITED STATES PATENT AND TRADEMARK OFFICE

CERTIFICATE OF CORRECTION

PATENT NO. : 6,010,415
DATED : January 4, 2000
INVENTOR(S) : Lawrence E. Miggins It is certified that error appears in the above-identified patent and that said Letters Patent is hereby corrected as shown below:

Column 3,
Line 23, cancel beginning with "percussion" to and including "team colors."

Column 4,
Line 4, insert the following:
-- be secured to the barrel 12 with screws, pins or other fastening means 22 known to those skilled in the art. The weighted ring 18 is preferably coated with a rubber or plastic layer to provide a resilient outer layer on the weighted ring 18. Preferably, the weighted ring 18 weighs up to approximately 16 ounces to provide a weighted practice bat 100. Preferably, the weighted practice bat 100 is similar in all respects to the batter's normal bat 10 which he is familiar with except for the addition of the weighted ring 18. The weighted practice bat 100 locates the weighted ring 18 at the exact sweet spot 20 of the bat 100. Thus, as the batter loosens up in the on deck circle with the weighted practice bat 100, the batter is made aware of the exact sweet spot 20 at which he wants to contact the ball.

The advantages of the weighted practice bat 100 are plentiful. The batter has a weighted practice bat to loosen up with which has the same size handle and length as his bat which he will use when facing the opposing pitcher. The weighted ring 18 is permanently secured at the exact sweet spot 20 of the weighted practice bat 100. The weighted ring 18 will not unexpectedly fly off of the bat 100. The weighted ring 18 always remains positioned over the sweet spot 20 which informs any player using the "regular" bat 10 of similar size and shape of the location of the sweet spot 20. The weight added to the bat is concentrated at the location of the sweet spot 20. The enlarged outer diameter of the weighted ring focuses the batter's attention directly to the location of the sweet spot 20 which is exactly where the batter's attention should be in order for the batter to learn where to instinctively make contact with the ball on the bat.

UNITED STATES PATENT AND TRADEMARK OFFICE

CERTIFICATE OF CORRECTION

PATENT NO. : 6,010,415
DATED : January 4, 2000
INVENTOR(S) : Lawrence E. Miggins It is certified that error appears in the above-identified patent and that said Letters Patent is hereby corrected as shown below:

Under no circumstances should it be possible that the weighted material free itself from the bat 100 and become a flying projectile.

Having described the invention above, various modifications of the techniques, procedures, material and equipment will be apparent to those in the art. It is intended that all such variations within the scope and spirit of the appended claims be embraced thereby. --.

Signed and Sealed this

Twelfth Day of February, 2002

*Attest:*

*Attesting Officer*

JAMES E. ROGAN
*Director of the United States Patent and Trademark Office*